US007781382B2

(12) United States Patent
Sekine et al.

(10) Patent No.: US 7,781,382 B2
(45) Date of Patent: Aug. 24, 2010

(54) LUBRICANT COMPOSITION AND BEARING STRUCTURE

(75) Inventors: Shigenobu Sekine, Tokyo (JP); Yurina Sekine, Tokyo (JP)

(73) Assignee: Napra Co., Ltd., Tokyo (JP)

( * ) Notice: Subject to any disclaimer, the term of this patent is extended or adjusted under 35 U.S.C. 154(b) by 356 days.

(21) Appl. No.: 11/606,897

(22) Filed: Dec. 1, 2006

(65) Prior Publication Data

US 2008/0132433 A1 Jun. 5, 2008

(51) Int. Cl.
*C10M 125/26* (2006.01)
*C10M 103/04* (2006.01)
*C10M 125/20* (2006.01)

(52) U.S. Cl. ..... 508/155; 508/165; 508/172; 977/724; 977/731; 977/778

(58) Field of Classification Search ..... 508/100–109, 508/132, 136, 154, 165, 172, 150, 155, 151; 977/724, 731, 778
See application file for complete search history.

(56) References Cited

U.S. PATENT DOCUMENTS 5,273,782 A * 12/1993 Sagawa et al. ..... 427/242
2004/0179762 A1* 9/2004 Doll et al. ..... 384/492
2007/0225178 A1* 9/2007 Sawyer et al. ..... 508/106

FOREIGN PATENT DOCUMENTS

| | | | |
|---|---|---|---|
| JP | 56-112995 A | | 9/1981 |
| JP | 1-92296 A | | 4/1989 |
| JP | 6-271882 A | | 9/1994 |
| JP | 2005213290 A | * | 8/2005 |

* cited by examiner

*Primary Examiner*—Glenn A Caldarola
*Assistant Examiner*—Pamela Weiss
(74) *Attorney, Agent, or Firm*—Westerman, Hattori, Daniels & Adrian, LLP

(57) ABSTRACT

There is provided a lubricant composition which includes: a first particle having a spherical shape having a diameter of 1 to 300 nm, having a Mohs hardness of 5 or more, at an amount of 0.01 to 40 weight %; and a second particle, having a diameter of 500 nm to 50 μm, having a Brinell hardness of 17 HB or less, at an amount of 0.01 to 40 weight %. The lubricant composition can form a bearing structure when the lubricant composition is subjected to an extreme pressure. The second particles are deformed into a retainer for the first particle.

9 Claims, 4 Drawing Sheets

LUBRICANT COMPOSITION AND BEARING STRUCTURE

FIELD OF THE INVENTION

The present invention relates to a lubricant composition, and in particular to a lubricant composition which can be used as a lubricant in a sliding portion, such as of a bearing.

RELATED ART

There are various conventional lubricant compositions. In order to improve performances, a solid additive can be added into the lubricant compositions, but conventional solid additives do not have a good affinity to the other ingredients, so the dispersion stability is poor. Thus, the conventional lubricant compositions including the solid additive do not show good lubricating properties when it is used as a lubricant for a bearing.

For example, JP6-271882 discloses a lubricant composition including spherical $SiO_2$ particles having a particle size of 0.2 to 0.4 μm, and fluorine resin particles. The spherical $SiO_2$ particles are served as bearing balls, and the fluorine resin particles are served as a solid additive. When the disclosed composition is used as a lubricant in a sliding portion, the fluorine resin particles exists between the spherical $SiO_2$ particles. However, the fluorine resin particles are not immobilized between the spherical $SiO_2$ particles. The fluorine resin particles cannot be served as a retainer of the spherical $SiO_2$ particles. Thus, the performance of the lubricant is poor, in particular in view of the durability and the noise. The lubricant composition cannot form a bearing structure when the lubricant composition is subjected to an extreme pressure.

The objective of the present invention is to provide a novel lubricant composition, which can be used as a lubricant in a sliding portion, showing a good performance such as durability without noise. In particular, the objective of the present invention is to provide a lubricant composition which can form a bearing structure when the lubricant composition is subjected to an extreme pressure.

SUMMARY OF THE INVENTION

There is provided a lubricant composition which includes: a first particle having a spherical shape having a diameter of 1 to 300 nm, having a Mohs hardness of 5 or more, at an amount of 0.01 to 40 weight %; a second particle, having a diameter of 500 nm to 50 μm, having a Brinell hardness value of 17 HB or less, at an amount of 0.01 to 40 weight %; and a lubricant base selected from the group consisting of grease and organic solvents.

The lubricant composition is capable of forming a bearing structure when the lubricant composition is subjected to an extreme pressure. The second particle is deformed into a retainer for the first particle.

The first particle can be made of a ceramics. In particular, the first particle can be $Al_2O_3$, BeO, CaO, MgO, $SiO_2$, $TiO_2$, Mullite, Spinel, Foresteright, Zirconia, or Zircon. In one embodiment, the diameter of the first particle is 1 to 300 nm, and in another embodiment, the diameter of the first particle can be 100 to 300 nm, and yet in another embodiment, the diameter of the first particle can be about 200 nm. The Mohs hardness of the first particle is 5 or more, and in one embodiment, the Mohs hardness of the first particle can be 6 or more, and in another embodiment, the Mohs hardness of the first particle can be about 6.7. In one embodiment, the first particle is included at an amount of 0.01 to 40 weight %. In one embodiment, the first particle can be included at an amount of 5 to 35 weight %, based on the total weight of the lubricant composition, and in another embodiment, the first particle can be included at an amount of 30 to 40 weight % based on the total weight of the lubricant composition. In yet another embodiment, the first particle can be included at an amount of 0.01 to 40 weight %, based on the total weight of the first particle and the second particle, and in yet another embodiment, the first particle can be included at an amount of 20 to 40 weight %, based on the total weight of the first particle and the second particle.

The second particle can be made of a metal or a metal nitride. In particular, the second particle can be made of Cu or BN (boron nitride). In one embodiment, the diameter of the second particle is 500 nm to 50 μm, and in another embodiment, the diameter of the first particle can be 500 nm to 10 μm, and in yet another embodiment, the diameter of the first particle can be about 5 μm. In one embodiment, the Brinell hardness of the second particle is 17 HB or less, and in another embodiment, the Brinell hardness of the second particle can be between 11HB and 17 HB, and in yet another embodiment, the Brinell hardness of the second particle can be about 13 HB. In one embodiment, the second particle is included at an amount of 0.01 to 40 weight %, and in another embodiment, the second particle can be included at an amount of 5 to 35 weight %.

The lubricant base of the present invention can be grease or organic solvents. The lubricant base can be a volatile organic solvent. The lubricant base can be a synthetic resin.

The grease of the present invention can include synthetic oils such as paraffin oils, naphthene, aromatic mineral oils, polymeric olefin oils, alkylate aromatic oils, polyether oils, ester oils, halogenated hydrocarbon oils, silicon oils, fluorinated oil, hydrogenated oils, solid or semi-solid paraffin, alcohol, and soaps such as metal soaps and soapless soaps; natural oils such as animal oils and vegetable oils. The grease is optional in the present invention. Without the grease, an oil-less bearing structure (or retainer) can be made.

The organic solvent of the present invention can include hydrocarbons, halogenated hydrocarbons, alcohols, phenol, ethers acids, esters, aldehydes, acetals, ketones, nitrogen containing compounds, sulfur compounds and sinner.

The lubricant composition can further include synthetic resins as a solid lubricant. The synthetic resins as a solid lubricant can include polyphenols, ABS resins, acetal resins, polycarbonates, epoxy resins, DVB resins, furan resins, fluorine resin, polyethylene, silicon resins, methacrylic resins, polyester resins, polyvinylchloride, melamine resins, acryl resin, composite gum, asphalt, pitch and tar. In one embodiment, a fluorine resin is included as a solid lubricant.

When the lubricant composition of the present invention is used as a lubricant in a sliding portion, and when an extreme pressure is applied to the sliding portion, the second particles are deformed to serve as a retainer of the first particle. FIG. 2 illustrates the lubricant composition of the present invention including a first particle 1 and a second particle 2. The lubricant composition is coated on a surface of a sliding member 3 made of e.g. iron. The sliding member has convexes and concaves on its surface. The depth of the concave is referred to as D. In one embodiment, D can be about 200 nm. After the lubricant composition is coated on the surface of the sliding member 3, a second sliding member (not shown in the drawings) is set up above the surface of the first sliding member 3, to apply a pressure. As increasing the pressure applied between the first sliding member 3 and a second sliding member 2, the second particle 2 is crashed to become crashed second particles 2' as shown in FIG. 3. As increasing the pressure to reach the extreme pressure of the present invention, the crashed second particles 2' are further deformed to become a retainer 2" for the first particle 1, so as to form a bearing structure of the present invention, as shown in FIG. 4. Since the second particles 2 are made of a material having the Brinell hardness as specified in the present invention, the second particles 2 can be easily crashed and deformed into a retainer 2" for the first particles 1. Accordingly, the first particles 1 can be served as bearing balls. The first sliding member 3 can be rotated with respect to the second sliding member. In the present invention, the friction and noises can be significantly reduced.

In the present invention, the deformation by the extreme pressure to form a retainer is refereed to as self organization. The extreme pressure is referred to as a pressure which is applied to the sliding portion of a bearing, which can cause the self organization to form the bearing structure of the present invention. The extreme pressure is not limited to a specific value, but in one embodiment, the extreme pressure is 300 kgf/cm or more, and another embodiment, the extreme pressure is between 100 kgf/cm and 1000 kgf/cm, and yet in another embodiment, the extreme pressure is between 500 kgf/cm and 750 kgf/cm.

EXAMPLES

The present invention is described hereinafter in more detail with reference to the Examples of the present invention. However, the scope of the present invention should not be limited with reference to the Examples.

Example 1

Figure 1:
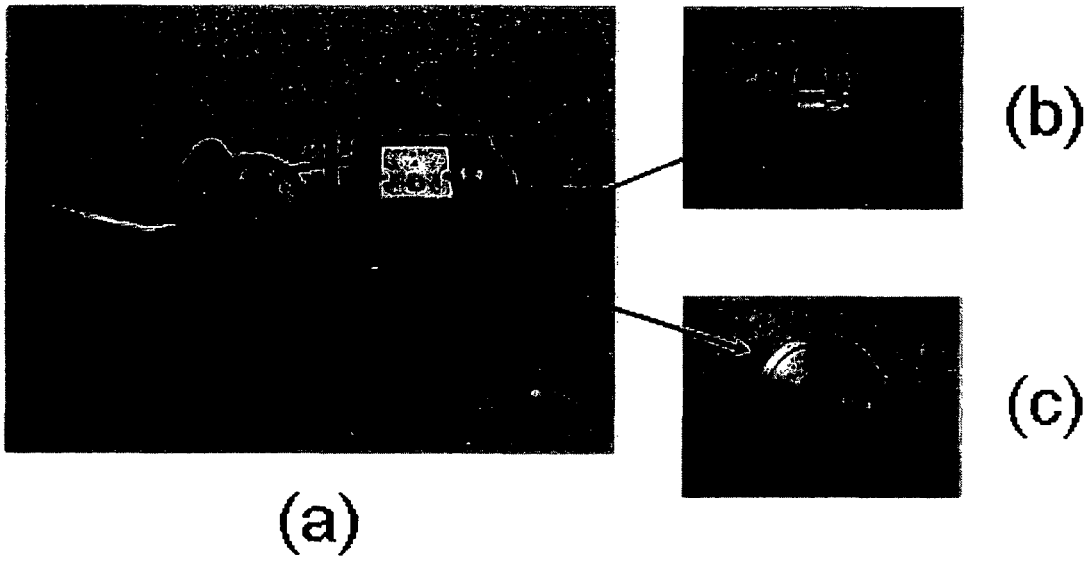
FIG. 1(*a*) shows an extreme pressure machine used in the Examples for applying an extreme pressure, and FIGS. 1(*b*) and 1(*c*) show the sliding portion of the extreme pressure machine.
Figure 2:
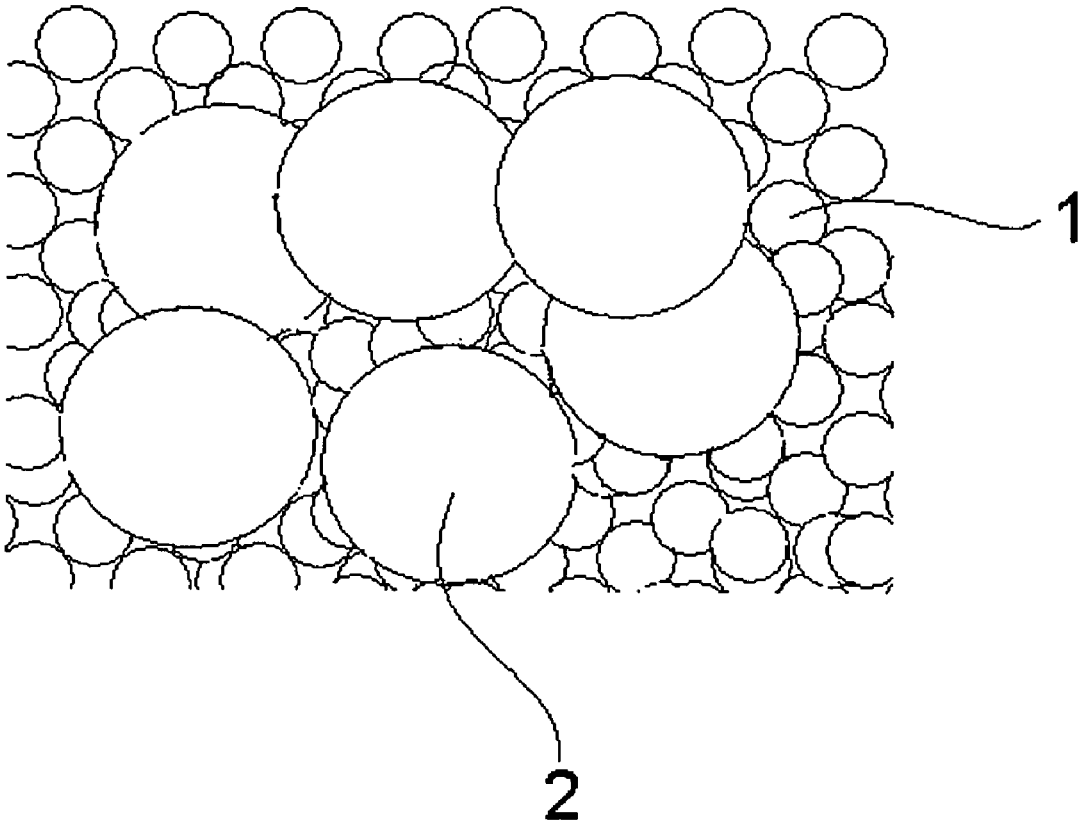
FIG. 2 illustrates a lubricant composition of the present invention.
Figure 3:
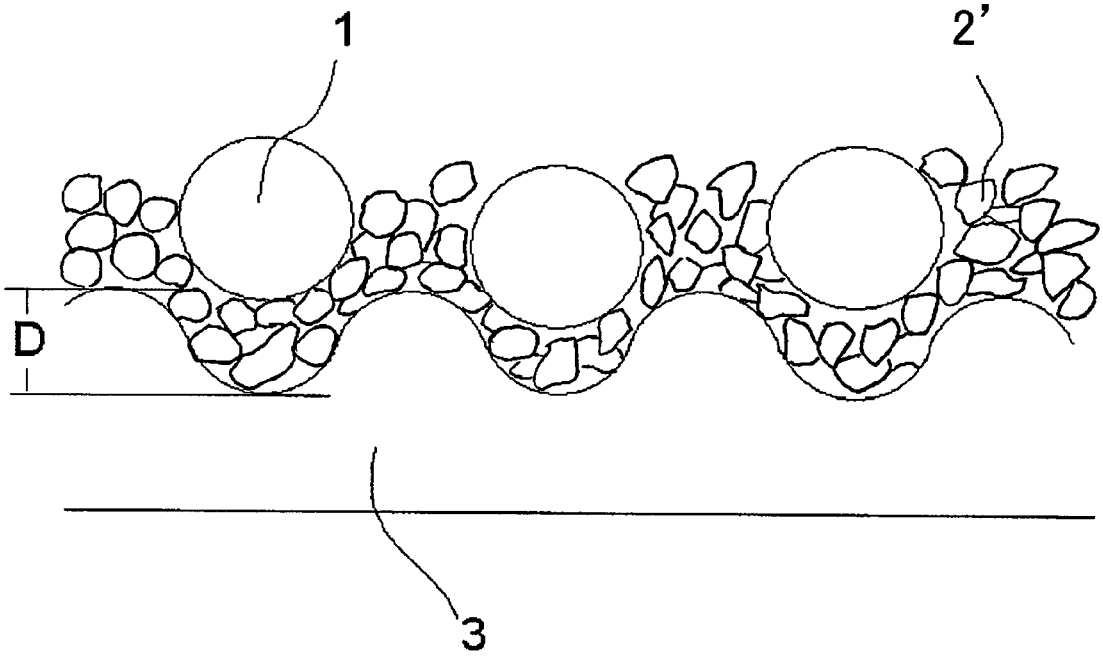
FIG. 3 illustrates a sliding portion as increasing a pressure applied to the lubricant composition of the present invention.
Figure 4:
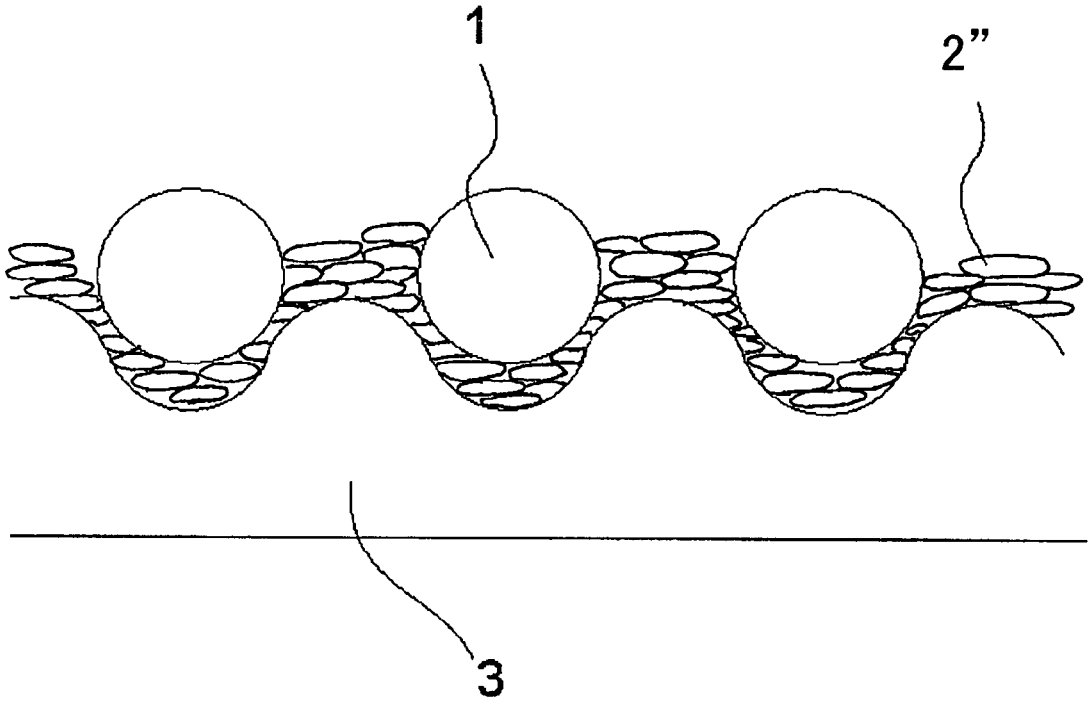
FIG. 4 illustrates a sliding portion when applying an extreme pressure to the lubricant composition of the present invention.

40 parts by weight of copper powder (Brinell hardness: 17 Hb) were mixed with a mixture of 30 parts by weight of $SiO_2$ particles (Mohs hardness: 7) and 30 parts by weight of parafin oil, to obtain a lubricant composition as Sample 1. The copper powder had a grain diameter of 5 μm. The $SiO_2$ particles had a grain diameter of 200 nm or less (about 200 nm). Sample 1 was then coated on a surface of a sliding portion of an extreme pressure machine (5-7LG2 manufactured by Nakamura Manufacturing Corporation) as shown in FIG. 1, and then an extreme pressure of 700 kgf/cm was applied to obtain a bearing structure of the present invention by the action of the self organization.

Example 2

Sample 2 was prepared in the same manner as Example 1 except for replacing the copper powder with 40 parts by weight of a boron nitride powder (Brinell hardness: 17 Hb or less). The boron nitride powder had a grain diameter of 1-3 μm.

Comparison Example 1

Sample 3 was prepared in the same manner as Example 1 except for missing the copper powder.

Tests

The lubricant compositions as prepared as Samples 1 to 3, coated on a sliding portion of the extreme pressure machine as shown in FIG. 1, were subjected to an extreme pressure of 750 kgf/cm$^2$, to measure a consumed electric value and durability.

As shown in Table 1 below, the lubricant compositions as Samples 1 and 2 could be operated for a period of 370 seconds or more. Also, the consumed electric values were low and stable.

On the other hand, the operation could not be continued after a period of 70 seconds in the lubricant composition as Sample 3. The consumed electric value was increased in Sample 3.

TABLE 1

| Time (seconds) | Sample 1 Consumed Electric Value (A) | Sample 2 Consumed Electric Value (A) | Sample 3 (Comp. Ex. Consumed Electric Value (A) |
|---|---|---|---|
| 0 | 5 | 5 | 5 |
| 40 | 5.1 | 5.1 | 5.3 |
| 50 | 5.1 | 5.1 | 5.4 |
| 60 | 5.2 | 5.1 | 5.5 |
| 70 | 5 | 5.1 | 5.5 |
| 90 | 5 | 5.1 | 5.5 |
| 120 | 5 | 5 | 5.5 |
| 180 | 5 | 5 | 5.5 |
| 240 | 5 | 5 | 5.5 |
| 300 | 5 | 5 | 5.5 |
| 330 | 5 | 5 | 5.8 |
| 360 | 5 | 5 | 6 |
| 370 | 5 | 5 | — |
| Note | Test was continued after 370 seconds. | Test was continued after 370 seconds. | Test was terminated at 370 seconds. |

What is claimed is:

1. A lubricant composition comprising:

a first particle having a spherical shape having a diameter of 1 to 300 nm, having a Mohs hardness of 5 or more, at an amount of 0.01 to 40 weight %;

a second particle made of boron nitride, having a diameter of 500 nm to 50 μm, having a Brinell hardness value of 17 HB or less, at an amount of 0.01 to 40 weight %; and a lubricant base selected from the group consisting of greases and organic solvents.

2. A lubricant composition according to claim 1, wherein the lubricant composition is capable of forming a bearing structure when the lubricant composition is subjected to an extreme pressure, the second particle being deformed into a retainer for the first particle.

3. A lubricant composition according to claim 1, wherein the first particle is made of a ceramics.

4. A lubricant composition according to claim 3, wherein the ceramics is $Al_2O_3$, BeO, CaO, MgO, $SiO_2$, $TiO_2$, Mullite, Spinel, Forsterite, Zirconia, or Zircon.

5. A lubricant composition according to claim 1, wherein the first particle is made of a metal oxide.

6. A lubricant composition according to claim 1, wherein the lubricant base is a volatile organic solvent.

7. A lubricant composition according to claim 1, wherein the lubricant base is a synthetic resin.

8. A bearing comprising a lubricant composition according to claim 1.

9. A bearing, comprising:

particles having a spherical shape having a diameter of 1 to 300 nm, having a Mohs hardness of 5 or more; and a retainer made of boron nitride having a Brinell hardness value of 17 HB or less, having a plurality of cavities for rotatablly holding the particles.

* * * * *